US006537095B1

(12) United States Patent
Azuma

(10) Patent No.: US 6,537,095 B1
(45) Date of Patent: Mar. 25, 2003

(54) LOW INSERTION FORCE TERMINAL

(75) Inventor: Eddie A. Azuma, Yokohama (JP)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/588,840

(22) Filed: Jun. 7, 2000

(30) Foreign Application Priority Data

Jun. 8, 1999 (JP) ..... 11-161632

(51) Int. Cl.[7] ..... H01R 13/625
(52) U.S. Cl. ..... 439/342; 439/259
(58) Field of Search ..... 439/259–265, 439/342

(56) References Cited

U.S. PATENT DOCUMENTS 4,997,385 A * 3/1991 Casagrande ..... 439/259
5,059,135 A * 10/1991 Matsuoka et al. ..... 439/268
5,092,789 A 3/1992 Sinclair ..... 439/259
5,370,549 A * 12/1994 Lee ..... 439/342
5,399,108 A * 3/1995 Lu et al. ..... 439/662
5,454,727 A * 10/1995 Hsu ..... 439/263
5,791,929 A * 8/1998 Banakis et al. ..... 439/342
6,074,233 A * 6/2000 Lin ..... 439/342
6,099,321 A * 8/2000 McHugh et al. ..... 439/342

FOREIGN PATENT DOCUMENTS

EP 0571 105 A1 11/1993
GB 2 286 490 A 8/1995

* cited by examiner

*Primary Examiner*—Brian Sircus
*Assistant Examiner*—Son V. Nguyen
(74) *Attorney, Agent, or Firm*—Perman & Green, LLP

(57) ABSTRACT

A low insertion force terminal comprising a female terminal (12) and a male terminal (11), the female terminal 12 being provided with a bottom (14) soldered to wiring, and a pair of opposing upright parts (15,16) extending from said bottom (14) in a cantilevered beam shape; and wherein an extended part (19) that projects on the distal end **(16*a*) of one of said upright parts (16) farther than the distal end part (15*a*) of the other upright part (15) in the widthwise direction is provided, and a male terminal supporting part (18) that grasps and supports the male terminal (11) is provided at a position in proximity to said extended part (19) of said pair of upright parts (15,16)**.

9 Claims, 2 Drawing Sheets

LOW INSERTION FORCE TERMINAL

TECHNICAL FIELD OF THE INVENTION

The present invention relates to a low insertion force terminal, and in particular relates to a terminal used in a surface mounted, high density electrical connector called a BGA connector (Ball Grid Array connector) that is connected to a substrate via a solder ball.

PRIOR ART

Parallel with the increasing density and reduction in size of electrical apparatuses such as computers, the development of BGA connectors that can reduce the mounting surface area is making progress. The BGA connector is a connector whose form has a plurality of terminals accommodated within the housing respectively connected to each of a plurality of exposed solder balls arranged in a array on one surface of a housing comprising an insulating material. When the BGA connector is mounted on a substrate, solder balls are placed in contact with a plurality of contact pads arranged on the substrate in the same manner and baked. During baking, a portion of each solder ball melts, and the terminal and contact pad are bonded via the solder ball. With this type of BGA connector, because the gap between adjacent solder balls can be extremely narrow, there are the advantages that the mounting surface area on the substrate is small, and extensive wiring can be implemented.

The structure disclosed, for example, in the Specification of U.S. Pat. No. 5,092,789, is a terminal used in this type of connector that has the terminals arranged in such an array. As shown in FIG. 3, the terminal 1 used in this connector comprises a female terminal 2 accommodated in a housing of the contact (not illustrated) and a male terminal 3 anchored to a lid member (not illustrated).

This male terminal 3 is formed into a round rod shape projecting in a vertically downward direction from the lid member. The female terminal 2 possesses a bottom part (not illustrated) through which a connection part (not illustrated) for connecting to the substrate projects from the bottom surface of the housing and a pair of upright parts 4, 5 extending in a cantilever beam shape upwards from this bottom part. On the upper ends of these upright parts 4, 5, opposing male terminal grasping parts 4*a*, 5*a*, are formed separated by a gap smaller than the diameter of the male terminal 3. When the male terminal 3 is inserted by pressing, the dimensions of the gap between these male connector grasping parts 4*a*, 5*a* expand, and due to the flexible restoring force of the upright parts 4, 5, the male terminal 3 can be supported in a grasped state.

In order to simplify the insertion of the male terminal 3 into the male support parts 4*a*, 5*a*, on one side in the widthwise direction of the male terminal support parts 4*a*, 5*a*, a guide part 6 is formed that has a pair of opposing out-turned surfaces 4*b*, 5*b* separated by a gap therebetween gradually widening in the widthwise direction from the male terminal support parts 4*a*, 5*a*. Therefore, when the male terminal 3 is inserted into the female terminal 2, the male terminal 3 must be pressed against each out-turned surface 4*b*, 5*b* of this guide part 6 and inserted while widening the gap between the male terminal support parts 4*a*, 5*a*.

PROBLEM TO BE SOLVED BY THE INVENTION

However, with the terminal 1 having this kind of structure, when the gap between the male terminal support parts 4*a*, 5*a* is pushed open by the male terminal 3, a force that pushes the male terminal 3 forward while overcoming the frictional force from the pair of out-tuned surfaces 4*b*, 5*b* in the guide part 6 of the female terminal 2, and a force acting on to the pair of out-turned surfaces 4*b*, 5*b* in order to flexibly deform the upright parts 4, 5 of the female terminal 2 must be applied simultaneously. Due to this, the peak value of the insertion force applied to the male terminal 3 is extremely high. Furthermore, when male terminals 3 and female terminals 2 a re connected simultaneously in a plurality of terminals 1 as in the case of a BGA connector, the insertion force that must be applied simultaneously to all terminals 1 becomes excessive. Depending on the case, carrying out the connection operation manually is difficult, and as disclosed in the Specification of U.S. Pat. No. 5,092,789, a handle for carrying out the connection operation must be provided.

SUMMARY OF THE INVENTION

In consideration of the above-described problems, an object of the present invention is to provide a low insertion force terminal comprising a female terminal and a male terminal, said female terminal being characterized in providing a bottom soldered to wiring and a pair of facing upright parts extending from said bottom in a cantilever beam shape; and wherein an extended part is provided that projects in the widthwise direction on the distal end of one of said upright parts farther than the distal end part of the other upright part, and a male terminal supporting part that grasps and supports the male terminal is provided at a position in proximity to said extended part of said pair of upright parts.

In the above-described low insertion force terminal, the extended part is formed so as to capable of being pressed by said male part, and at the same time the contact surface with the male part from said extended part to said male terminal support part is flattened in the widthwise direction of said upright part.

Furthermore, in the above-described low insertion force terminal, the contact surface with the male terminal from the extended part to the male terminal support part is formed so as to curve in the lengthwise direction of the upright part such that a convex surface is imparted.

OPERATION

According to the low insertion force terminal of the present invention, when a male terminal and a female terminal are connected, the extended part formed at the distal end of one of the upright parts is pressed. Thereby, the distal end of this one upright part is separated from the distal end of the other upright part, and an insertion space for the male terminal can be maintained. In this state the male terminal is moved in the widthwise direction of the upright parts of the female terminal, and after being moved up to the male terminal support part in proximity to the extended part, the pressing force applied to the extended part is released, and thereby the male terminal is grasped within the male terminal support part of the female terminal, and both terminals become electrically and mechanically connected.

In this case, because the male terminal is inserted between the upright parts after carrying out the separation operation of the upright parts of the female terminal separately from the insertion operation of the male terminal, the male terminal and female terminal can be connected without excessive insertion force.

Furthermore, because the extended part can be pushed by the male terminal and the contact surface with the male terminal from this extended part to the male terminal supporting part is flattened in the widthwise direction of the upright parts, in the state wherein the pair of upright parts are separated, simply by moving the male terminal along the widthwise direction of the upright parts, the male terminal can be moved from the extended part to the male terminal support part without fluctuation of the frictional force. That is, since there is no peak value for the frictional force, the insertion force can be decreased.

In addition, because the contact surface with the male terminal from the extended part to the male terminal support part is formed by curving the upright part in the lengthwise direction so as to impart a convex surface, the contact surface area with the male terminal is decreased, and the frictional force generated while the male terminal moves to the male terminal support part can be decreased.

DETAILED DESCRIPTION OF THE INVENTION

Figure 1:
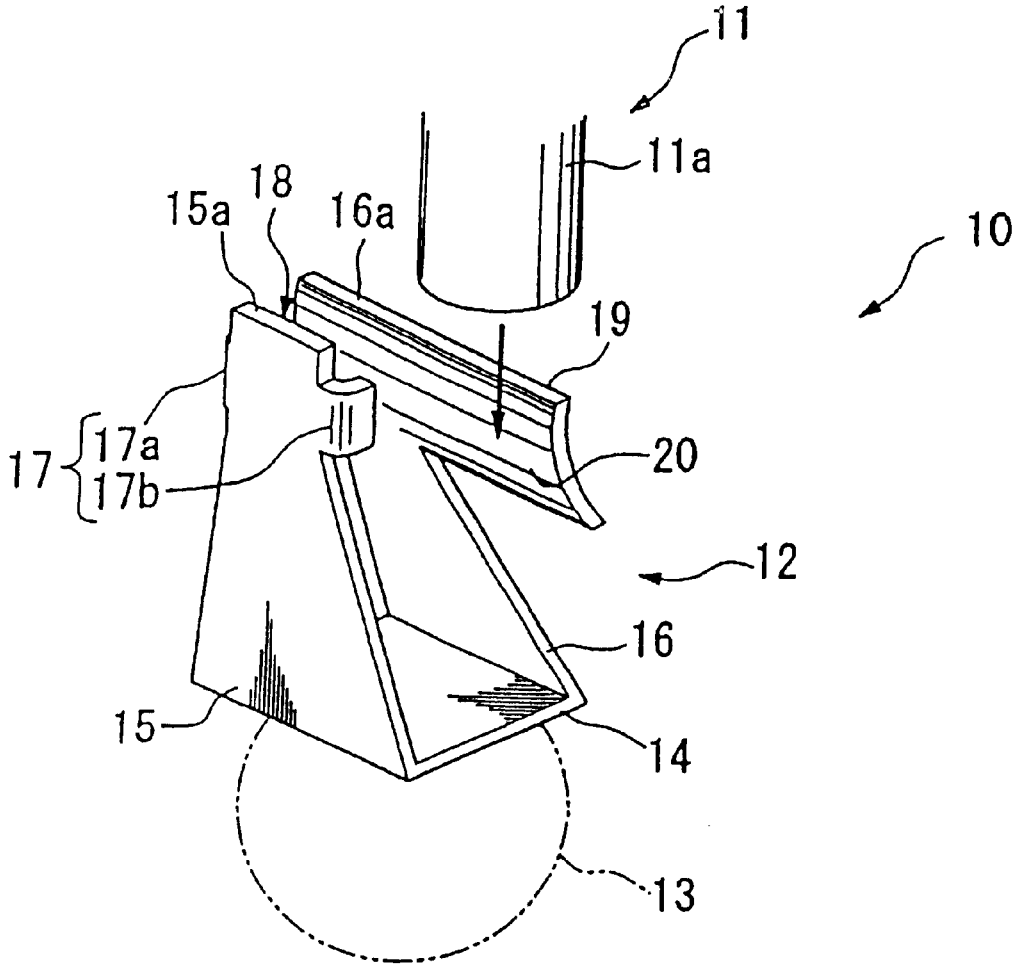
FIG. 1 is a perspective drawing showing the low insertion force terminal according to an embodiment of this invention.
Figure 2A:
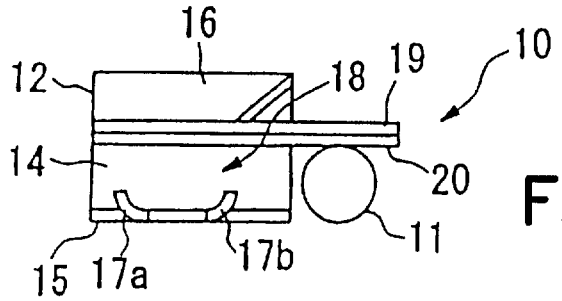
FIG. 2 is a plane drawing for explaining the operating state of the low insertion force terminal in FIG. 1.
Figure 2B:
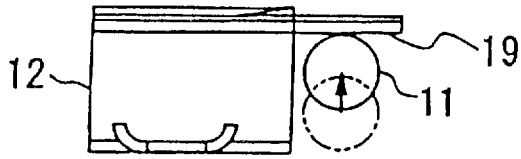
Figure 2C:
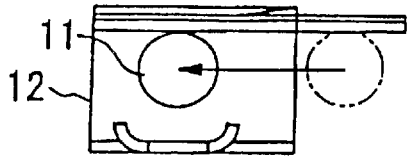
Figure 2D:
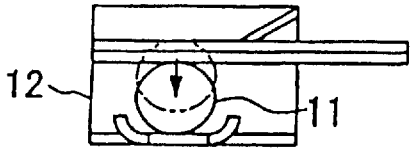
Figure 3:
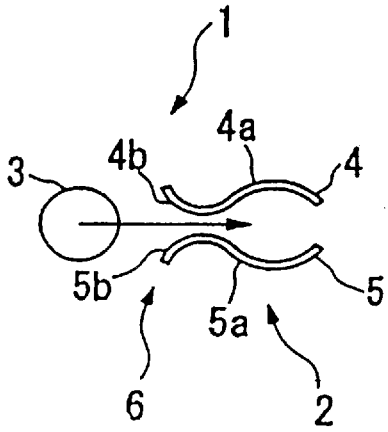
FIG.3 PRIOR ART
FIG. 3 is a schematic drawing showing a conventional terminal.

The low insertion terminal according to a first embodiment of the invention is explained below referring to FIG. 1 and FIG. 2. As shown in FIG. 1, the low insertion force terminal 10 according to the present embodiment is formed by a male terminal 11 and a female terminal 12.

The male terminal 11 has a round rod shaped contact surface 11*a*, and other aspects of the shape are matters of suitable design.

The female terminal 12 is formed by bending one piece of a metal plate, and for example, in a BGA connector, provides a bottom 14 mounted on a soldering ball 13 so as to be anchored to the wiring of a substrate (not illustrated) via the soldering ball 13 and a pair of upright parts 15, 16 extending from both edges of this bottom 14 upwards in the form of a cantilever beam.

The upright parts 15, 16 are formed from a first upright part 15 that rises in a substantially vertical direction from one edge of the bottom part 14 that is disposed horizontally and a second upright part 16 that rises from the other edge of the bottom 14 towards the distal end 15*a* of the first upright part 15 and inclines so that the gap with the first upright part 15 gradually narrows. The gap between the distal end 15*a* of the first upright part 15 and the distal end 16*a* of the second upright part 16 is smaller than the dimension of the diameter of the contact part 11*a* of the male terminal 11, and when the male terminal 11 is held between both distal ends 15*a*, 16*a*, due to the elasticity of the pair of upright parts 15, 16, the dimensions are set so that the male terminal 11 and the female terminal 12 are connected with sufficient contract pressure.

On the distal end 15*a* of the first upright part 15, a male terminal accommodation part 17 is provided that restricts the movement of the male terminal 11 in the horizontal direction by accommodating this male terminal 11 between curved parts 17*a*, 17*b*, formed by slightly bending both widthwise ends of the distal end 15*a* in the direction of the distal end 16*a* of the second upright part 16. The male terminal support part 18 that grasps and holds the male terminal 11 is formed by this male terminal accommodation part 17 and the distal end 16*a* of the second upright part 16 facing this male terminal accommodation part 17.

In addition, on the distal end 16*a* of the second upright part 16, an extending part 19 is formed by extending widthwise one end thereof further in the horizontal direction than the distal end part 15*a* of the first upright part 15. This extended part 19 projects in the widthwise direction by a dimension that is larger than the distal end 15*a* of the first upright part 15, and at least larger than the radial dimension of the contact part 11*a* of the male terminal 11. Thereby, as shown in FIG. 2 (*a*), in the state wherein the first and second upright parts 15, 16 come very close to the distal ends 15*a*, 16*a*, the male terminal 11 abuts the extended part 19, and can flexibly deform the second upright part 16 in the direction of separation from the first upright part 15 up to the position shown in FIG. 2 (*b*).

Furthermore, on the distal end 16*a* of the second upright part 16, from the extended part 19 to the male terminal support part 18, a contact surface 20 is provided that is formed having a flat shape in the widthwise direction of the upright part 16, that is, in the horizontal direction. Thereby, as shown in FIG. 2 (*c*), the male terminal 11 separates the second upright part 16 from the first upright part 15 by pushing on the extended part 19, and can move from the extended part 19 to the male terminal support part 18 smoothly, without fluctuation of the frictional force, when moving horizontally along this contact surface 20.

In addition, the contact surface 20 is formed into a convex curved surface along the lengthwise direction of the upright part 16, that is, along the vertical direction, in the direction of the first upright part 15. Thereby, the male terminal 11 reliably contacts this contact surface 20 at a point contact or at a contact surface with an extremely small area. In addition, the distal end 16*a* will reciprocate with the second terminal part 16 being flexibly deformed by the male terminal 11, but even in this case, the surface contact area between the male terminal 11 and the distal end 16*a* remains extremely small.

In addition, when male terminal 11 is moved in the horizontal direction, no matter where the initial position of the male terminal 11 is during the flexible deformation of the upright part 16, the male terminal 11 is moved while maintaining an extremely small contact surface area with the upright part 16 and a reliable contact. As a result, due to this small contact surface area, the frictional force that the male terminal 11 receives from the female terminal 12 becomes significantly reduced, and the male terminal 11 can be moved horizontally up to the male terminal supporting part 18 with an extremely small force.

Finally, as shown in FIG. 2 (*d*), by decreasing the pushing force applied to the male terminal 11 in order to flexibly deform the second upright part 16, the second upright part 16 returns in the direction approaching the first upright part 15 due to its elasticity, the male terminal 11 is accommodated in the male terminal accommodation part 17 of the first upright part 15, and at the same time, is made to contact the inner surface of the male terminal accommodation part 17 with a specified contact force due to the elasticity of the second upright part 16.

As a result, the male terminal 11 is mechanically connected to the female terminal 12 in a state wherein its displacement in a horizontal direction is restricted by the male terminal supporting part 18 comprising the male terminal accommodation part 17 and the distal end 16*a* of the second upright part 16. At the same time, due to an appropriately applied contact pressure, the male terminal 11 electrically contacts the female terminal 12.

Therefore, in the low insertion force terminal 10 according to the present embodiment, the pair of upright parts 15, 16 of the female terminal 12 are separated by the male terminal 11 without producing friction between the upright parts 15, 16 and the male part 11, and thereafter the male terminal 11 is moved to the male terminal support part 18 by overcoming an extremely small frictional force that is due to reducing the contact surface area. Subsequently, simply by decreasing the force separating the pair of upright parts 15, 16, the male terminal 11 is accommodated in the male terminal accommodation part 17, and both terminals 11, 12 are electrically and mechanically connected. Thereby, the effects can be achieved that during the connection operation between the male terminal 11 and the female terminal 12, the maximum value of the insertion force that should be applied is greatly reduced in comparison to a conventional terminal, and at the same time, in spite of this low insertion force, a reliable electrical and mechanical connection state is attained.

As a result, in particular when a BGA connector having this kind of low insertion force terminals 10 arranged in plurality in an array is employed, the maximum value of the insertion force necessary to connect simultaneously these terminals 10 can be greatly reduced. Therefore, conventionally, the mechanism such as a lever that is required due to the excessive insertion force applied during the connection operation can be simply structured.

Moreover, the low insertion terminal 10 according to the present embodiment has a contact part 11*a* of a round rod shaped male terminal 11, but instead, a structure with a contact part 11*a* having an arbitrary shape, such as an angular column or a plate shape can be used. In addition, in the present embodiment, the male terminal accommodation part 17 that forms the male terminal support part 18 can be formed on the distal end 15*a* of the first upright part 15 on which the extended part 19 is not provided, and instead, can be formed on both the distal end of 16*a* of the second upright part 16 or on either the distal ends 15*a*, 16*a* of the first and second upright parts 15, 16. In this case, the male terminal accommodating part 17 formed on the second upright part 16 providing the extended part 19 can be formed by indenting the contact surface 20 of the distal end 16*a* so that the frictional force during the movement of the male terminal 11 from the extended part 19 to the male terminal accommodation part 17 is not increased.

Effects of the Invention

As described in detail above, the low insertion force terminal according to the present invention achieves the effects that the conventional form, wherein the upright part of the female terminal is pushed open by the male terminal, can be eliminated. Instead a structure is used in which the male terminal is grasped and held by the female terminal after the male terminal is moved while maintaining a low frictional force with respect to the female terminal while the female terminal is being pushed open without friction between the male terminal and female terminal. Thus, the maximum value of the insertion force necessary to connect the male terminal and female terminal is greatly lowered, and an electrical and mechanical connection between both terminals can be reliably attained.

In addition, the connection operation can be carried out smoothly without producing a peak in the frictional force of the insertion by forming a flat contact surface from the extended part to the male terminal supporting part.

Furthermore, by imparting a convex shape to the contact surface, the structure is extremely simple, the contact surface area between with the male terminal is reduced, and the frictional force produced between both can be lowered.

What is claimed is:

1. A low insertion force terminal comprising:

a female terminal and a male terminal, said female terminal comprising:

a bottom sized and shaped for soldering the female terminal to a conductor; and a pair of opposing upright parts extending from said bottom in a cantilever beam shape and terminating in distal ends which are laterally spaced apart from one another and at equal height from the bottom; and wherein one of said opposing upright parts has an extended part which projects in a widthwise direction at one of the distal ends corresponding to said one of said upright parts, the extended part extending in said widthwise direction from said one of said upright parts to beyond a distal end part of another of said upright parts, and said opposing upright parts define a male terminal support part that holds and supports the male terminal when the male terminal is mated to the female terminal, the male terminal support part being located at a position in proximity to said extended part of said pair of upright parts.

2. The low insertion force terminal according to claim 1 wherein said extended part is formed so as to be capable of being pressed by said male terminal during insertion of the male terminal, a contact surface of said one upright part which extends widthwise relative to said one upright part from said extended part to said male terminal support part and which contacts the male terminal being flattened substantially concurrently with the extended part being pressed by the male terminal during insertion of the male terminal.

3. The low insertion force terminal according to claim 1, wherein a contact surface of said one upright part extending from said extended part to said male terminal support part is curved lengthwise relative to said upright part to define a convex surface.

4. A low insertion force terminal comprising:

a male terminal; and a female terminal shaped for receiving the male terminal, the female terminal comprising;

a base section for connecting the female terminal to a conductor;

a pair of spaced apart cantilevered parts depending from the base section, the pair of cantilevered parts forming a male terminal support section for holding the male terminal when the male terminal is mated to the female terminal, the support section having an axis of insertion of the male terminal into the male terminal support section, wherein a first of the cantilevered parts has a male terminal engagement tab projecting transversely relative to the first cantilevered part from the male terminal support section, the tab being disposed at a distal end of the male terminal support section at an equal height and opposite from another distal end of a second of the cantilevered parts, the tab engaging the male terminal during insertion of the male terminal when the male terminal is moved during insertion in a direction substantially transverse to the axis of insertion such that interaction of said tab and said male terminal increase the distance between said spaced apart cantilevered parts.

5. A low insertion force terminal according to claim 4, wherein the second of the cantilevered parts has a pair of inwardly curved parts at the male terminal support section.

6. A low insertion force terminal according to claim 4, wherein the male terminal engagement tab extends transversely from the male terminal support section across the male terminal when the male terminal is moved during insertion in the direction transverse to the axis of insertion.

7. A low insertion force terminal according to claim 4, wherein the male terminal engagement tab is displaced in the transverse direction by the male terminal, displacement of the engagement tab effecting displacement of the first cantilevered part away from the second of the cantilevered parts so that when the male terminal is moved along the insertion axis into the male terminal support section, the male terminal contacts only one of the opposing cantilevered parts.

8. A low insertion force terminal according to claim 7, wherein the second cantilevered part has an inwardly turned lip substantially opposite the engagement tab.

9. A low insertion force terminal according to claim 7, wherein the second cantilevered part has an inwardly turned lip projecting into a gap between the cantilevered parts through which the male terminal passes when moved along the axis of insertion into the support section, the lip projecting into the gap so that when the first cantilevered part is in an undisplaced position, the lip bars the male terminal from passing through the gap.

* * * * *